United States Patent [19]

Shepard

[11] Patent Number: 4,799,643

[45] Date of Patent: Jan. 24, 1989

[54] SHELF BRACKET

[75] Inventor: John S. Shepard, Windsor, Colo.

[73] Assignee: SISU Shelving Corporation, Fort Collins, Colo.

[21] Appl. No.: 639,827

[22] Filed: Aug. 13, 1984

[51] Int. Cl.[4] ..... A47B 96/06

[52] U.S. Cl. ..... 248/544; 248/247; 248/250

[58] Field of Search ..... 248/235, 247, 248, 250, 248/544

[56] References Cited

U.S. PATENT DOCUMENTS

| | | | |
|---|---|---|---|
| D. 270,034 | 8/1983 | Shepard . | |
| 3,110,934 | 11/1963 | Triplett | 248/247 |
| 3,695,569 | 10/1972 | Pullan | 248/235 |
| 4,289,289 | 9/1981 | Overman | 248/235 |
| 4,385,565 | 5/1983 | Roberts | 248/235 |

*Primary Examiner*—J. Franklin Foss

*Assistant Examiner*—Robert A. Olson

*Attorney, Agent, or Firm*—Hugh H. Drake

[57] ABSTRACT

Shelf brackets are each in the form of a unitary body which has a vertical back wall. Defined in the body is a platform that projects outwardly away from the back wall a given distance and is inclined in the outward direction upwardly at an angle substantially between one-half and five degrees with respect to the back wall. Also defined in the body is a ledge that projects outwardly away from that back wall generally parallel to the platform. The ledge is spaced above the platform by an amount to accommodate receipt of a shelf board inserted between the platform and the ledge. Defined in the body is an opening for enabling securement of the body to a mounting surface. A further feature is an enlargement communicating outwardly from that opening that forms a channel which may accommodate receipt of an end of a hanger or the like. As shown, the ledge does not project as far outwardly as the platform.

9 Claims, 3 Drawing Sheets

SHELF BRACKET

The present invention pertains to shelf brackets. More particularly, it pertains to brackets enabling the formation of a shelving system by fastening the brackets to a wall and then inserting a shelf board into the brackets.

A number of shelf brackets are known to the prior art, of which U.S. Pat. Nos. D270,034, 4,183,488, and 4,231,300, and the references cited by the Patent Office in connection with those, are representative. Other representations of prior art include U.S. Pat. Nos. 654,402, 1,586,213, 2,653,783 and 3,370,388, as well as United Kingdom Patent No. 2,053,666.

Some of such prior suggestions pertain to brackets that have a special mounting structure in order to fasten them to a wall. Others are of a kind suitable only to be used in space-opposed pairs at opposing sides of a shelf board which is to be mounted.

It is a general object of the present invention to provide new and improved shelf brackets which enable the support of a shelf board from one edge thereof without more.

Another object of the present invention is to provide new and improved shelf brackets which are readily securable to essentially any type of wall surface.

A further object of the present invention is to provide new and improved shelf brackets which are inherently formed to achieve the mounting of a shelf that is level when loaded and in accomodation of mounting-wall variances.

A shelf bracket constructed in accordance with the present invention includes a unitary body with a vertical back wall. A platform defined in the body projects outwardly away from the back wall a given distance. A ledge is defined in the body to project outwardly from that back wall generally parallel to the platform, with the ledge being spaced above the platform by an amount to accomodate receipt of a shelf board inserted between the platform and the ledge. Defined in the body are means for enabling securement of the body to a mounting surface.

One feature presented is that the platform is inclined in the outward direction upwardly at an angle substantially between one-half and five degrees with respect to the back wall. A different but yet preferably related feature is the inclusion of an opening for mounting purposes, located beneath the platform, and which continues into an enlarged channel which will accomodate receipt of a member within the channel.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
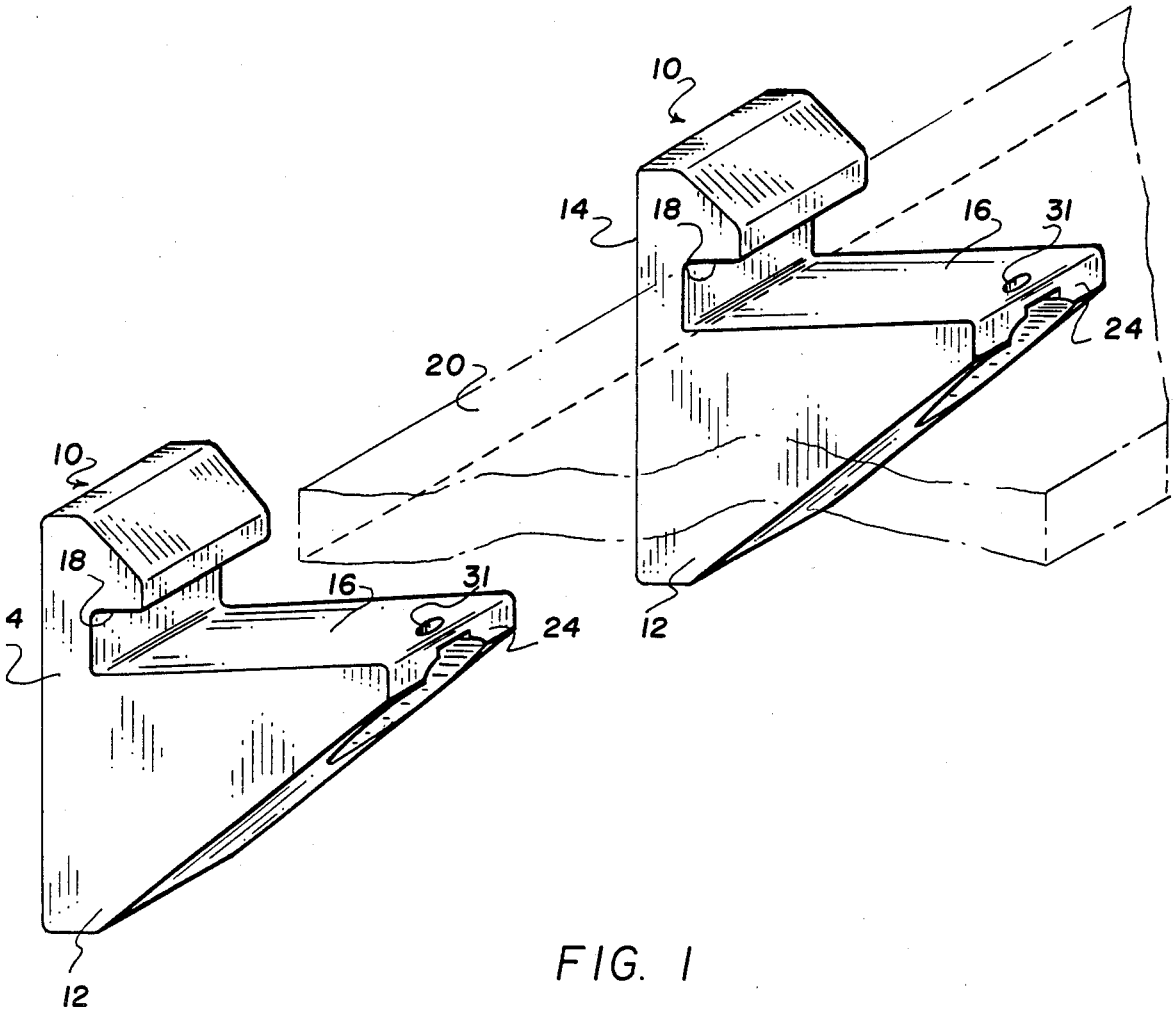
FIG. 1 is an isometric view depicting a pair of shelf brackets disposed to support a shelf board.
Figure 2:
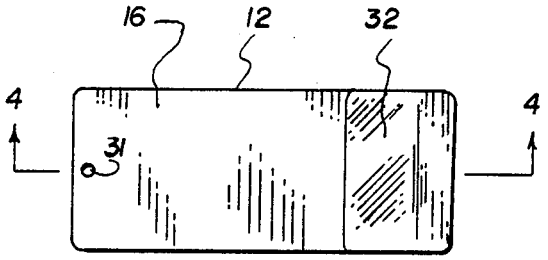
FIG. 2 is a top plan view of one bracket.
Figure 3:
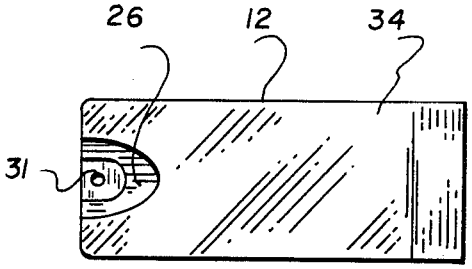
FIG. 3 is a bottom plan view thereof.

A shelf bracket 10 is in the form of a unitary body 12 that has a vertical back wall 14. A platform 16 projects outwardly away from the remainder of body 12 a given distance from back wall 14. A ledge 18 also defined in the body projects outwardly away from back wall 14 generally parallel to platform 16. Ledge 18 is spaced above platform 16 by an amount to accomodate receipt of a shelf board 20 which is inserted between platform 16 and ledge 18. Ledge 18 serves as a cleat on the back edge portion of the shelf board, tending to keep that shelf board from tilting downward. Defined in body 12 is an opening 22 which enables securement of the body to the mounting surface.

Figure 4:
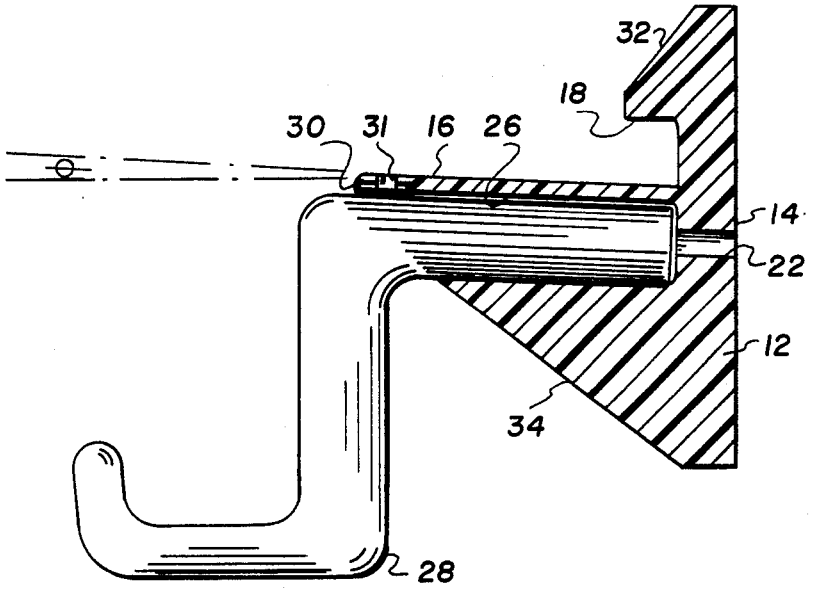
FIG. 4 is a cross-sectional view taken along the line 4—4 in FIG. 2 and also including a representation of an additional component.

As can be seen best in FIG. 4, back wall 14 is, of course, intended to be mounted against the surface of a wall. A fastener, such as simply an elongated screw, is inserted through opening 22 in order to secure the bracket to that wall. That form of securement will suffice if the brackets can be located opposite a stud buried within the wall or if the wall material itself is of appropriate construction to accept a mere screw for attachment. Different wall construction might require a variation in the type of fastener employed, as is well known. For example, securement to a concrete wall may require the insertion of an anchor. Panelboard or thinly-panelled walls suggest the use of a kind of anchor which has a base first set in the wall after which a screw or like device is inserted through opening 22 and brought into engagement with the base. On the other hand, back wall 14 might be provided with some kind of clip or other engaging device which interfits with a mating element installed on the mounting surface.

As depicted in FIG. 4, platform 16 is inclined upwardly and outwardly at an angle of $\theta$ degrees to the horizontal when back wall 14 is vertical. That is, angle $\theta$ is measured relative to a plane that perpendicularly intersects back wall 14. Ledge 18 is generally parallel to platform 16. As illustrated, the opposing side walls of unitary body 12 together with back wall 14 rigidly maintain the orientation of platform 16 and ledge 18 relative to back wall 14 and to each other. A preferred value of angle  is approximately two degrees. However, it may be anywhere between about one-half degree and up to five degrees. In any event, the result of such angulation is that the shelf board as finally loaded will normally be oriented in about the horizontal direction, notwithstanding difference from the true vertical in the mounting surface and the weight of the load.

Opening 22, which is located beneath platform 16, is exposed to the front side 24 of body 12 through communication with an enlarged tubular channel 26 which continues through body 12 to front side 24 in order to accomodate receipt of such as a hanging member 28, or the like, as illustrated in FIG. 4. That is, member 28 can simply be plugged into channel 26 for whatever purpose it is to serve. Channel 26 not only accomodates the mounting of a hanging structure or the like as shown at 28 but also facilitates mounting by the user with a tool needed to engage a fastener which is inserted through opening 22.

At the top of channel 26 is a short keyway 30 having a hole 31 through which a fastener may be inserted upwardly through platform 16 in order to secure shelf board 20 against being withdrawn from bracket 10.

It will be observed that ledge 18 projects outwardly away from back wall 14 a distance which is substantially less than the distance by which platform 16 projects outwardly from back wall 14. That preferred approach leaves a maximum of the upper surface of self board 20 available for storage. Yet, a secure cleating is still ensured.

Figure 5:
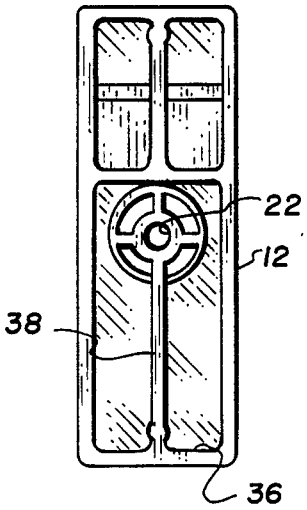
FIG. 5 is a rear-elevational view thereof.
Figure 6:
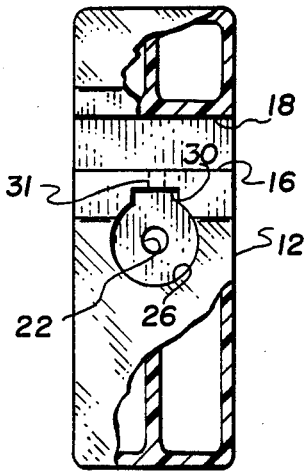
FIG. 6 is a front-elevational view thereof, particularly broken away to reveal internal structure.

As shown, body 12 includes an exterior upper surface that has a portion 32 which is inclined downwardly from the top of back wall 14 toward the outer end of ledge 18. At the same time, body 12 includes an exterior lower surface 34 which is inclined upwardly from the bottom of back wall 14 toward the outer end of platform 16. As seen best in FIG. 5, back wall 14 includes a recess 36 in which are disposed reinforcing ribs 38 which include provision for the continuation of opening 22.

Preferably, body 12 is molded from a plastic which desirably is colored to match surroundings. On the other hand, it is apparent that body 12 may be a shaped metal part or even composed of a pair of such parts which cooperate together. It also will observed that more than one fastening opening, such as at opening 22, may be provided. In the normal shelving environment, that is not necessary unless the weight to be held is sufficient to demand more than one fastening device in order to handle the necessary shear strength. For normal applications, one opening is sufficient, because two or more brackets tend to align themselves with the shelf board that is installed on the brackets. Moreover, opening 22 preferably is located about mid-way of the height of back wall 14.

With this approach, it has been found, at least for most usual applications, that the formation of body 12 from rigid plastic can support a wide shelf board with no necessity of doing anything further. Simply-molded flat and smooth surfaces of platform 16 and ledge 18 have been found to be entirely satisfactory. If desired, of course, one may include a protuberance on the under side of ledge 18 or affix to either of the surfaces of ledge 18 or platform 16 some kind of friction-establishing material. Nevertheless, such embellishments have not been found to be necessary.

As such, the size of body 12 may be varied as required. In a typical embodiment, the height of bracket 10 is about 4 inches, while the length from the back wall to the front of platform 16 is slightly less. With those dimensions, and molding from plastic, the thickness of the bite of the "U" formed by the structure of platform 16 and ledge 18 need only to be about one half inch, while the length of ledge 18 need only be about the same, The spacing between platform 16 and ledge 18 is preferably selected to accomodate one of the standard shelf board thicknesses which, in the United States, typically are three-fourths inch and five-eights inch. A corresponding width of the bracket is about one and one-half inches. Thus, the bracket width is only a small fraction of the length of the shelf board span supported from any one bracket to the next. That is, the width of each shelf bracket is at least an order of magnitude or at least ten times less than the spacing between any two successive brackets.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A shelf bracket comprising:

a rigid unitary body having a vertical back wall and side walls;

a flat and smooth platform defined in said body to project outwardly away from said back wall a given distance and inclined in the outward direction upwardly at an angle substantially between $1\frac{1}{2}$ and 5 degrees with respect to a plane perpendicularly intersecting said back wall;

a flat and smooth ledge defined in said body to project outwardly away from said back wall generally parallel to said platform, said ledge being spaced above said platform by an amount to accommodate receipt of a shelf board inserted between said platform and said ledge;

and means defined in said body for enabling securement of said body to a mounting surface.

2. A shelf bracket as defined in claim 1 in which said enabling means includes means defining an opening through said backwall and exposed to the front side of said body for allowing the insertion of a fastener that secures said backwall to said surface;

in which said opening is located in said body beneath said platform;

and in which said opening communicates outwardly from said backwall into a tubular channel enlarged relative to said channel, which opening continues through said body to said front side to accomodate receipt of a member plugged into said channel.

3. A shelf bracket as defined in claim 2 in which includes means defined in said platform for permitting insertion of a fastener upwardly through said channel into said shelf board.

4. A shelf bracket as defined in claim 1 in which said ledge projects outwardly away from said back wall a predetermined distance substantially less than said given distance.

5. A shelf bracket as defined in claim 1 in which said angle is approximately two degrees.

6. A shelf bracket as defined in claim 1 in which width of said bracket is only a small fraction of the length of shelf board span supported from one said bracket to another such bracket spaced from said one bracket.

7. A shelf bracket comprising a unitary body having a vertical back wall;

a platform defined in said body to project outwardly away from said back wall a given distance;

a ledge defined in said body to project outwardly away from said back wall generally parallel to said platform, said ledge being spaced above said platform by an amount to accomodate receipt of a shelf board inserted between said platform and said ledge;

means defining an opening through said backwall and exposed to the front side of said body for allowing the insertion of a fastener that secures said back wall to a mounting surface, said opening being located beneath said platform;

and means defining a tubular channel enlarged relative to said opening and continuing outwardly from said opening through said body to said front side to accomodate receipt of a member plugged into said channel.

8. A shelf bracket as defined in claim 7 in which said ledge projects outwardly away from said back wall a predetermined distance substantially less than said given distance.

9. A shelf bracket comprising:

a rigid unitary body having a vertical back wall and side walls;

a platform defined in said body to project outwardly away from said back wall a given distance and inclined in the outward direction upwardly at an angle substantially between one-half and five degrees with respect to a plane perpendicularly intersecting said back wall;

a flat and smooth ledge defined in said body to project outwardly away from said back wall generally parallel to said platform, said ledge being spaced above said platform by an amount to accomodate receipt of a shelf board inserted between said platform and said ledge;

means defined in said body for enabling securement of said body to a mounting surface;

and said ledge projecting outwardly away from said back wall a predetermined distance substantially less than said given distance and presenting a surface to said shelf board which is continuous from one side wall to the other in the elongate direction of said shelf board.

* * * * *

UNITED STATES PATENT OFFICE

CERTIFICATE OF CORRECTION

Patent No. 4,799,643 Dated Jan 24, 1989

Inventor(s) John S. Shepard

It is certified that error appears in the above-identified patent and that said Letters Patent is hereby corrected as shown below:

Column 2, line 44: after "angle" and before "is", insert -- θ --.

Column 3, line 3: cancel "self" and substitute -- shelf --.

Column 4, line 8: cancel "1½" and substitute -- ½ --.

Signed and Sealed this

Twenty-second Day of August, 1989

*Attest:*

DONALD J. QUIGG

*Attesting Officer*

*Commissioner of Patents and Trademarks*